United States Patent [19]

Schlinkmann et al.

[11] Patent Number: 4,997,552

[45] Date of Patent: Mar. 5, 1991

[54] LINEAR SORTING MACHINE AND METHOD

[75] Inventors: Alex W. Schlinkmann, Plantation; Jeffrey A. Strain, Sunrise, both of Fla.

[73] Assignee: Motorola, Inc., Schaumburg, Ill.

[21] Appl. No.: 389,213

[22] Filed: Aug. 3, 1989

[51] Int. Cl.[5] ..... B07C 5/36

[52] U.S. Cl. ..... 209/552; 209/573; 209/905; 209/921; 324/158 F; 901/40

[58] Field of Search ..... 209/573, 571, 905, 914, 209/921, 552; 414/751, 752; 901/40, 6, 13; 324/158 F, 73.1

[56] References Cited

U.S. PATENT DOCUMENTS

| | | | |
|---|---|---|---|
| 3,341,928 | 9/1967 | Naumann | 209/573 X |
| 4,587,703 | 5/1986 | Azizi et al. | 901/40 X |
| 4,607,525 | 8/1986 | Turner et al. | 324/158 F X |
| 4,657,470 | 4/1987 | Clarke et al. | 901/40 X |
| 4,720,227 | 1/1988 | Eberle | 414/752 X |
| 4,908,126 | 3/1990 | Willberg et al. | 209/573 |

FOREIGN PATENT DOCUMENTS

| | | | |
|---|---|---|---|
| 1-172772 | 7/1989 | Japan | 324/158 F |

OTHER PUBLICATIONS

"Chiphandler Apparatus for Testing Semiconductor Devices", *IBM Technical Disclosure Bulletin*, Fromer et al., vol. 20, No. 3, Aug. 1977, pp. 1100-1101.

*Primary Examiner*—Donald T. Halec
*Attorney, Agent, or Firm*—Michael J. Buchenhorner

[57] ABSTRACT

An apparatus and a method for sorting parts to be tested. A first head selects a part and places the part in a testing location. A second head positions the part in a testing location where the part is tested to determine whether it conforms to certain criteria. The second head then places the tested part in a first storage location if the part conforms to the criteria, or in a second storage location if the part does not conform to the criteria.

17 Claims, 2 Drawing Sheets

LINEAR SORTING MACHINE AND METHOD

TECHNICAL FIELD

This invention relates generally to apparatuses for testing electronic parts and more specifically to sorting machines for testing integrated circuit carriers and hybird modules.

BACKGROUND

Most automated sorting operations are three step processes: (1) choosing the part to be tested out of a feeder and placing it on a tester; (2) testing the part; and (3) placing the tested part into one bin if the part passes the test, or placing it into another bin if it does not pass the test. Linear actuators, such as linear motors (or forcers), are well suited for such sorting applications. A grasping end, or other grabbing device, can be mounted on a linear motor head for picking up the part to be tested. The motor can be moved over an input site where it can select a part and move it to another location for testing. Once in the tester, the part can be tested and then taken to its corresponding bin determined on the basis of the test results. This method works for most sorting processes. However, when sorting parts such as chip carriers, even the fastest linear motors cannot develop high enough throughput to keep up with the speed of the tester.

Moreover, holding the part to be tested (e.g., integrated circuit chip carriers or hybrid modules) presents some additional problems. Holding integrated circuit chip carriers or hybrid modules in test nests is usually accomplished by a four-bar clamping mechanism. Generally, a push block is attached to an end of the clamping mechanism for holding the chip during testing. The holding force is set by manually adjusting the height of this block. Such push blocks are custom built for the particular part to be tested. Manufacturing variations and wear on the four bar linkage pivots cause wide variations in the pressure exerted on the part being tested. These variations contribute to electrical repeatability problems.

SUMMARY OF THE INVENTION

Accordingly, it is an object of the present invention to provide an apparatus and a method for sorting and testing chip carriers in test nests that avoids the above-discussed problems.

Briefly, according to the invention, an apparatus and a method are provided for sorting parts to be tested. A first head selects a part and places the part in a testing location. A second head positions the part in a testing location where the part is tested to determine whether it conforms to certain criteria. The second head then places the tested part in a first storage location if the part conforms to the criteria, or in a second storage location if the part does not conform to the criteria.

DETAILED DESCRIPTION OF THE PREFERRED EMBODIMENT

Figure 1:
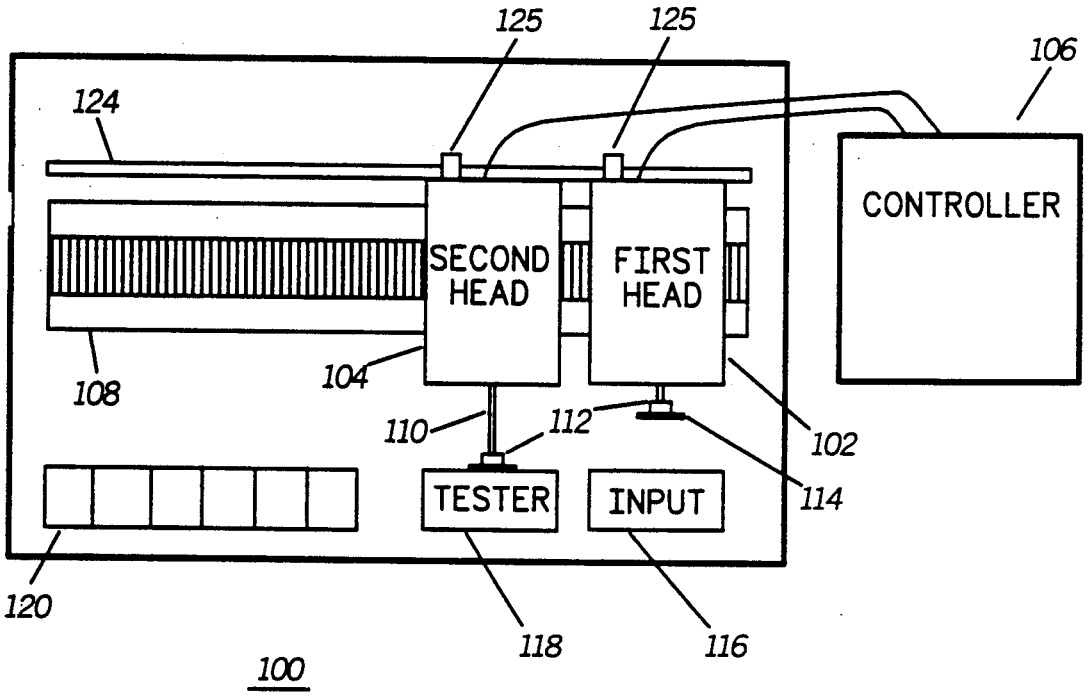
FIG. 1 shows an apparatus for testing and sorting parts in accordance with the invention.

Referring to FIG. 1, there is shown an apparatus 100 for testing and sorting parts in accordance with the invention. A first head 102 is mounted on a linear track (or platen) 108 so that it can move along the track 108. The linear track 108 is mounted on a base plate 122. The first head 102 includes an vacuum pick 110 (or other grasping means) with a grasping end 112 for picking a part 114 to be tested. A linear motor (not shown) moves the head along the track 108. The part 114 is contained in a feeder which places the part 114 in a specified position and conditions it for testing.

A second head 104 is also moveably mounted on the same linear rack 124. The second head 104 also includes a vacuum pick 110 with a grasping end 112. The part 114 is tested in a tester 118. Several bins 120 are provided for storing each part 114 after testing according to the results of the test.

A controller 106 (e.g., a computer or microprocessor) is coupled to the first and second heads 102 and 104 to control their motion along the track 108. A glass scale 124 and a transducer 125 can be used in conjunction with the controller 106 to monitor the position of the heads on the track 108, thus providing a closed-loop positioning means.

The first head 102 selects the part 114 to be tested from the feeder 116 as follows. The first head 102 moves along the track 108 until it is positioned above the feeder 116. Then, its vacuum pick 110 lowers from a first position to a second position. When the vacuum pick 110 is in the second position the grasping end 112 attaches itself to the part 114 selected for testing. The vacuum pick 110 then moves from the second position to the first position. The first head 102 then moves along the track 108 until it is above the test site. Next, the actuator vacuum pick 110 moves from the first position to the second position so that the part 114 is placed within the tester 118 for testing. The grasping end 112 of the vacuum pick 110 then releases the part 114. After releasing the part 114, the vacuum pick 110 moves back to the first position and the first head 102 moves along the track 108 to its prior position over the feeder 116 to select the next part to be tested.

Next, the second head 104 moves along the track 108 into a position over the tester 118 and lowers its actuator vacuum pick 110 until its grasping end 112 contacts the part 114 and exerts sufficient force on it so that the part can be tested. After testing, the controller causes the second head to move its actuator vacuum pick 110 from the second position to the first position (the grasping end 112 is still grasping the part 114) and to move along the track 108 until the second head is over one of several bins 120 that has been selected as a result of the test. The grasping end 112 then releases the part 114 so that it drops a safe distance into the appropriate bin 120.

Figure 2:
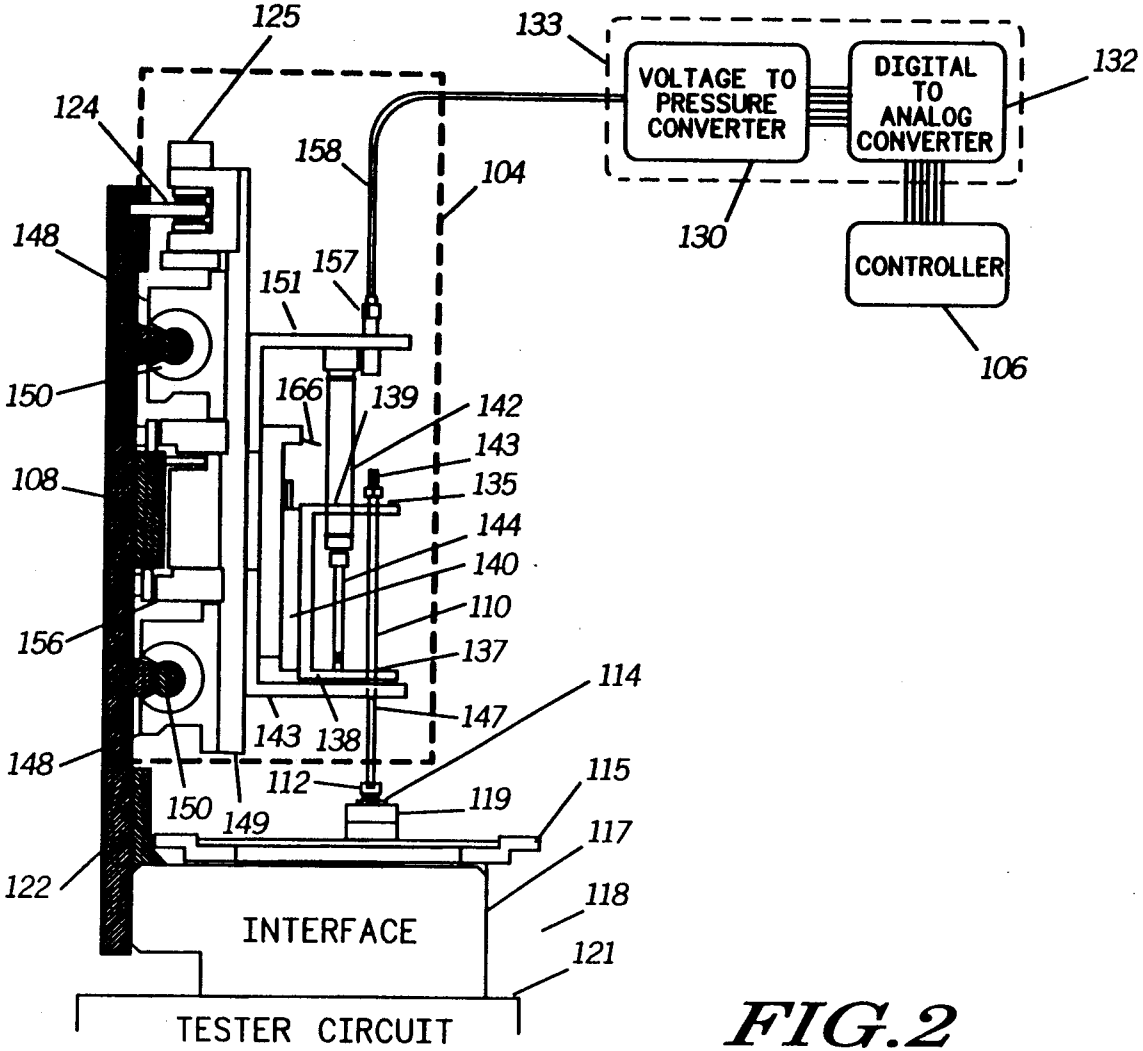
FIG. 2 shows a head used in the tester/sorter apparatus shown in FIG. 1.

Referring to FIG. 2, the second head 104 used in the tester/sorter apparatus 100 (illustrated in FIG. 1) is shown in greater detail. The second head 104 comprises a piston cylinder 142 and a piston rod 144. The piston rod 144 is attached to an actuator arm 138. The arm 138 has openings 135 and 137, through which the the vacuum pick 110 is attached to the arm 138. The arm 138 is also attached to a linear slide 140, which is slidably connected to a rail 141. The rail 141 is attached to a frame 145 which is, in turn, attached to lower bracket 143 and to upper bracket 151. The lower bracket 143 has an opening 137, through which the vacuum pick 110 passes freely as it moves. The cylinder 142 is also passes freely through an opening 139 in the upper portion of the arm 138. The cylinder 142 is attached to the upper bracket 151. A switch 166, in the frame 145, is activated by the arm 138 as it moves up past the switch 166. Thus the switch 166 acts as a position indicator for the arm 138. A connector 157 connects the cylinder 142 to a line 158 that leads to a voltage to pressure converter 130.

A frame 149 provides the backbone of the second head 104. Brackets 143 and 151 are attached to the frame 149. A linear motor 156, an encoder reader head 125, and two bushings 150 are also attached to the frame 149. The linear motor 156 moves the second head 104 along the track 108. The encoder reader head 125 determines the position of the second head 104 along the track 108 by reading information recorded on a scale 124 (preferably a glass scale) attached to the track 108.

Rails 150 are attached to the base plate 122. The bushings 148 fit slidably along the rails 150 to provide support for the second head 104, as it moves along the linear track 108.

The tester 118 (which can also be attached to the base plate 122) comprises a receptacle 119 for the part 114, a support table 115, upon which the receptacle 119 rests, an interface 117, and a testing circuit 121. The receptacle 119 provides means for probing electrical connections on the part 114. The interface 117 is disposed between the receptacle 119 and the testing circuit 121 for providing the required connections into the testing circuit 121. The first head 102, preferably places the part 114 within 1.0 mils of the specified location.

The motion of the second head 104 is controlled by the controller 106. The position of the second head 104 (and of the first head 102), is monitored by the encoder reader head 125 and scale 124, is transmitted to the controller 106, thus providing closed loop position control. When the controller 106 determines that the part 114 is to be tested, it first causes a solenoid (not shown) to apply sufficient force to the arm 138 to move the grasping end 112 of the vacuum pick 110 on the part 114. The controller 106 then produces a digital signal representing a selected fluid pressure in the cylinder 142. Thus, when the second head 104 is to exert the force required for testing on the part 114, the controller produces a signal representing a higher pressure in the cylinder 142 (causing the arm 138 to move downward and exert a selected force on the part 114). The signal produced by the controller 106 is applied to a voltage to pressure converter 130 that establishes the required pressure in the cylinder 142 in response to a given voltage. The magnitude of the selected fluid pressure is sufficient to cause the tester 118 to perform the required test. However, the voltage to pressure converter 130 requires an analog signal voltage in order to produce the required pressure. Therefore, a digital to analog converter 132 must be disposed between the controller 106 and the voltage to pressure converter 130. The controller 106 also monitors the pressure state of the vacuum pick 110 to determine whether the part 114 was not picked up, or correctly picked up. In cases where the part 114 was not picked up or incorrectly picked up there is no vacuum established in the vacuum pick 110. That information is transmitted to the controller 106 which then interrupts the testing process until the vacuum pick 110 resumes correct operation.

The voltage to pressure converter applies fluid at the selected pressure to the cylinder 142 through a line 158 and a connector 157. The controller 106 provides a digital signal to the tester 118 to start a testing process. When a given test is complete, the controller 106 receives the test results and produces a digital signal that causes the voltage to pressure converter to reduce the fluid pressure in the cylinder 142. Then a spring (or other means, not shown) causes the arm 138 to return to the position it had before the pressure was increased. The controller then commands the linear motor 156 to move the second head 104 over one of several locations depending on the results of the test. Once the second head 104 is over the selected location the pressure in the vacuum pick 110 is increased, causing the part to drop into the selected location (where the appropriate bin catches it).

The structure of the first head 102 is the same as that of the second head, except that the first head only uses a fluid piston (or solenoid, not shown) to regulate the pressure in the cylinder 142.

What is claimed is:

1. A sorting machine, for sorting parts to be tested in a testing location, comprising:

input means for introducing a part into the machine;

a linear track;

a first head moveably mounted to the linear track, for selecting the part and placing the part in the testing location;

testing means for testing the part placed in the testing location, to determine whether the part conforms to certain criteria;

a first storage location for storing parts that conform to the criteria;

a second storage location for storing parts that do not conform to the criteria;

a second head moveably mounted to the linear track, for positioning the part in the testing location for testing the part, and for storing the part into the appropriate storage location determined by the testing means; and a closed-loop positioning means, for controlling the positions of the first and second heads along the linear track.

2. The sorting machine of claim 1, wherein the second head comprises:

a first actuator for moving the second head along the track; and a second actuator for moving the part from a first position to a second position and for moving the part from the second position to the first position.

3. The sorting machine of claim 2, wherein the second actuator comprises:

an actuator arm;

grasping means attached to the actuator arm for grasping the part;

means for moving the actuator arm from a first position to a second position and for moving the actuator arm from the second position to the first position; and control means for controlling the motion of the actuator arm.

4. The sorting machine of claim 3, wherein the means for moving the actuator arm from a first position to a second position further comprises a fluid pressure activated piston means.

5. The sorting machine of claim 4, wherein the control means provides a digital signal representing a selected pressure to be established in the piston means, and wherein the second actuator further comprises a fluid pressure regulator for regulating the fluid pressure within the piston means.

6. The sorting machine of claim 5, wherein the fluid pressure regulator comprises:

a voltage to pressure converter; and a digital to analog converter, disposed between the control means and to the voltage to pressure converter, for converting the binary signal to an analog signal and applying the analog signal to the fluid pressure regulator so that the voltage to pressure converter produces the selected pressure.

7. The sorting machine of claim 6, wherein the second actuator further comprises:

a position sensor coupled to the actuator arm for sensing the position of the actuator arm and transmitting a signal representing the position of the actuator arm to the control means.

8. The sorting machine of claim 1, wherein the first head comprises:

a first actuator for moving the first head along the track; and a second actuator for moving the part from a first position to a second position and for moving the part from the second position to the first position.

9. The sorting machine of claim 8, wherein the second actuator comprises:

an actuator arm;

grasping means attached to the actuator arm for grasping the part;

means for moving the actuator arm from a first position to a second position and for moving the actuator arm from the second position to the first position; and control means for controlling the motion of the actuator arm.

10. The sorting machine of claim 9, wherein the means for moving the actuator arm from a first position to a second position further comprises an electrically activated fluid pressure piston means.

11. The sorting machine of claim 10, wherein the control means provides a digital signal representing a selected pressure to be established in the piston means, and wherein the second actuator further comprises a fluid pressure regulator for regulating the fluid pressure within the piston means.

12. The sorting machine of claim 11, wherein the fluid pressure regulator comprises a fluid activated piston means.

13. The sorting machine of claim 12, wherein the second actuator further comprises:

a position sensor coupled to the actuator arm for sensing the position of the actuator arm and transmitting a signal representing the position of the actuator arm to the control means.

14. The sorting machine of claim 13, wherein the first actuator comprises a linear motor.

15. A linear fluid-powered actuator for moving a part to be tested comprising:

an actuator arm;

grasping means attached to the actuator arm for grasping the part; and a fluid pressure activated piston means for moving the actuator arm from a first position to a second position and for moving the actuator arm from the second position to the first position control means for controlling the motion of the actuator arm, the control means provides a digital signal representing a selected pressure to be established in the piston means; and a fluid pressure regulator, for regulating the fluid pressure within the fluid-powered actuator, comprising a voltage to pressure converter; and a digital to analog converter, disposed between the control means and to the voltage to pressure converter, for converting the binary signal to an analog signal and applying the analog signal to the fluid pressure regulator so that the voltage to pressure converter produces the selected pressure.

16. The linear of claim 15, wherein the second actuator further comprises:

a position sensor coupled to the actuator arm for sensing the position of the actuator arm and transmitting a signal representing the position of the actuator arm to the control means.

17. In a sorting machine having a first head and a second head mounted on a linear track, a method for sorting parts to be tested comprising the steps of:

(a) selecting a part to be tested, using the first head;

(b) moving along the linear track from an original site to a testing site, placing the part selected in the testing site, and returning to the original site, using the first head;

(c) moving along the linear track to the testing site and positioning the part selected within the testing site so that it can be tested, using the second head;

(d) testing the part selected to determine whether the part complies with certain criteria;

(e) placing the part in a first location, using the second head, when the part complies with the criteria; and (f) alternately placing the part in a second location, also using the second head, when the part does not comply with the criteria.

* * * * *